US011618038B1

(12) United States Patent
Richmond

(10) Patent No.: US 11,618,038 B1
(45) Date of Patent: Apr. 4, 2023

(54) HORIZONTALLY DISPOSED SERIAL ELUTRIATION APPARATUS

(71) Applicant: James Richmond, Redding, CA (US)

(72) Inventor: James Richmond, Redding, CA (US)

( * ) Notice: Subject to any disclaimer, the term of this patent is extended or adjusted under 35 U.S.C. 154(b) by 0 days.

(21) Appl. No.: 17/527,409

(22) Filed: Nov. 16, 2021

(51) Int. Cl.
*B03B 5/40* (2006.01)
*B03B 11/00* (2006.01)

(52) U.S. Cl.
CPC ..... *B03B 5/40* (2013.01); *B03B 11/00* (2013.01); *B03B 2005/405* (2013.01)

(58) Field of Classification Search
CPC .... B03B 5/28; B03B 5/36; B03B 5/40; B03B 5/42; B03B 5/623; B03B 11/00; B03B 2005/405
See application file for complete search history.

(56) References Cited

U.S. PATENT DOCUMENTS 4,810,370 A * 3/1989 Taskinen ..... B03B 5/36 209/460
6,139,684 A * 10/2000 Lawson ..... B03D 1/028 162/232
7,147,111 B2 * 12/2006 Fendley ..... B01D 21/34 210/522
9,499,404 B2 * 11/2016 Chandran ..... B01D 53/18
9,700,900 B1 * 7/2017 Olivier ..... B03B 5/56
2019/0321831 A1 * 10/2019 Previero ..... B03B 5/02

* cited by examiner

*Primary Examiner* — Michael McCullough
*Assistant Examiner* — Jessica L Burkman
(74) *Attorney, Agent, or Firm* — Donald R. Boys; Central Coast Patent Agency LLC

(57) ABSTRACT

An elutriation apparatus has a mechanism adapted to move water along a path, the water entraining material particles of different density, and a plurality of elutriation columns interfaced to the mechanism adapted to move the water with entrained particles, the elutriation columns interfaced along the path, each elutriation column having a vertical bore with water controlled to travel up the vertical bore at one velocity and having also a capture element at the bottom of the bore. As the water with entrained particles passes over each interface to an elutriation column along the path, particles of a density sufficient for the particles to settle in the elutriation column at a velocity greater than the upward velocity of water in the bore of the elutriation column, settle to the bottom of the column, and particles of lesser density pass on to a next elutriation column interfaced along the path.

11 Claims, 6 Drawing Sheets

HORIZONTALLY DISPOSED SERIAL ELUTRIATION APPARATUS

BACKGROUND OF THE INVENTION

1. Field of the Invention

The present invention is in the technical field of apparatus and methods for separating materials of different density from a mixture of materials,

2. Description of Related Art

The process of the present invention is termed elutriation in the art. Elutriation is a process for separating particles based on particle density, using typically a stream of gas or liquid flowing in a direction opposite to the direction of sedimentation.

The sedimentation aspect of separation in elutriation apparatus is gravity driven. In a vertical column, for example, water may be fed to travel upward in a laminar flow with a mixture of particles of solid or semi-solid matter entrained in the water. Some heavier particles will sink in the water column more rapidly than the upward velocity of the water in the column and will collect at the bottom of the column. Lighter particles will travel upward with the water flow and may be caused to spill over an upper barrier. The density of particles that will settle or rise can be varied by varying the velocity of the upward flow of water in the column.

There are several problems often experienced in vertically oriented up-flow elutriation apparatus. One is that the column holding process material typically is rather large in diameter, and it is difficult to control the internal flow conditions to provide a truly laminar flow. Another is that with a single column only particles of a certain density will be separated out, and readjustment must be done to configure to retrieve particles of a different density.

The inventor has determined that what is clearly needed is a horizontally oriented material delivery apparatus with a serial plurality of elutriation columns that may be controlled to separate particles of different density in each column.

BRIEF SUMMARY OF THE INVENTION

In one embodiment of the invention an elutriation apparatus is provided, comprising a mechanism adapted to move water along a path, the water entraining material particles of different density, and a plurality of elutriation columns interfaced to the mechanism adapted to move the water with entrained particles, the elutriation columns interfaced along the path, each elutriation column having a vertical bore with water controlled to travel up the vertical bore at one velocity, and having also a capture element at the bottom of the bore. The apparatus is characterized in that, as the water with entrained particles passes over each interface to an elutriation column along the path, particles of a density sufficient for the particles to settle in the elutriation column at a velocity greater than the upward velocity of water in the bore of the elutriation column, settle to the bottom of the column, and particles of lesser density pass on to a next elutriation column interfaced along the path.

In one embodiment the mechanism adapted to move water along a path is an apparatus comprising an outer cylindrical housing having a length from a first end to a second end assembled concentrically with an inner cylindrical housing of the same length, creating an annular space between the housings, and a spiral fin implemented in the annular space, providing a spiral path from the first end to the second end. Also, in one embodiment the apparatus further comprises a first opening in a top region of the outer cylindrical housing with a hopper proximate the first end adapted to receive a mixture of particulate material, a water injection tube passing into the annular space through the hopper, and a second opening through a top region of the inner cylindrical housing proximate the second end, such that water injected via the injection tube entrains particles from the mixture and urges the water with entrained particles along the spiral path, and the water flows at the second end downward through the second opening into a volume constrained by the inner cylindrical housing. In one embodiment the plurality of elutriation columns interface to the elutriation apparatus through the outer cylindrical housing into the annular space by an interface cell at a top end of each elutriation column along a line in the direction of an axis of the housings through a bottom region of the outer cylindrical housing. And in one embodiment the plurality of elutriation columns are implemented in a row, side, by side, with a spacing the same as the spacing of one complete turn of the spiral path, such that the interface cell of each elutriation column enters the spiral path centrally between turns of the spiral fin, so that the water with entrained particles passes over each interface cell in turn as the water follows the spiral path.

In one embodiment of the apparatus each elutriation column in the plurality of columns is fed water by an adjustable flow meter, such that the upward velocity of flow in each elutriation column is different, and particles of a different density are collected in each of the elutriation columns. Also, in one embodiment the interface cell of each elutriation column is rectangular with a length and a width, the length of the cell aligned in the axis direction of the housings, and a rectangular upper opening tapers to a round bore of the elutriation column. In one embodiment the bore is one-half inch, the length of the rectangular upper opening if three inches and the width of the rectangular upper opening is one-half inch. In one embodiment the rectangular upper opening is even with the inside diameter of the outer cylindrical housing, and the interface cell further comprising a riffle panel extending upward along the length of one side of the interface cell such that the water with entrained particles passes over the riffle panel before passing over the rectangular opening, and the riffle panel creates turbulence in the water over the rectangular opening. And in one embodiment the capture element is a removable cap, such that the cap may be removed to remove particles captured in the cap.

In one embodiment the apparatus further comprises a drainpipe coupled into the inner volume of the inner cylindrical housing, the drainpipe extending in the direction of the axis out of the inner volume and then upward to a level above an uppermost edge of the outer cylindrical housing, such that water fills the spiral path, flows out ad up in the drainpipe, and exits the apparatus at the top of the drainpipe. And in one embodiment the drainpipe is adapted to rotate about the axis of the cylindrical housings, such that the apparatus may be drained by rotating the drainpipe, so the exit of the drainpipe is below a lowermost edge of the outer cylindrical housing.

In another aspect of the invention a method for separating particles of different density from a mixture of material having particles of different density is provided, comprising placing a portion of the mixture of material having particles of different density into an elutriation apparatus having a mechanism adapted to move water along a path, through a hopper proximate one end of the apparatus, adding water through an inlet through the hopper, creating a flow of water entraining material particles of different density, guiding the water entraining particles of different density along the path, interfacing a plurality of elutriation columns to the mechanism adapted to move the water with entrained particles, the elutriation columns interfaced along the path, each elutriation column having a vertical bore with water controlled to travel up the vertical bore at one velocity, and having also a capture element at the bottom of the bore, separating from the water entraining particles of different density, at each elutriation column, particles of a density sufficient for the particles to settle in the elutriation column at a velocity greater than the upward velocity of water in the bore of the elutriation column, and collecting the separated particles from the capture element at the bottom of each elutriation column.

In one embodiment of the method the mechanism for moving the water along the path comprises an apparatus having an outer cylindrical housing with a length from a first end to a second end assembled concentrically with an inner cylindrical housing of the same length, creating an annular space between the housings, and a spiral fin implemented in the annular space, creating a spiral path for water from the first end to the second end, and the method further comprises placing a portion of the mixture of material having particles of different density into the spiral path through a hopper proximate one end of the apparatus, adding water to create water entraining particles of different density, and guiding the water along the spiral path over the top of each of the plurality of elutriation columns.

In another aspect of the invention a method for separating particles of different density from a mixture of material having particles of different density is provided, comprising feeding material having a broad range of particles of different density to one end of a screening machine having a mechanism for moving the material over a series of sections each having a screen of a different granularity, operating the screens at each section to separate out particles of a particular size range, guiding the particles separated out at each section to a plurality of elutriation apparatuses, each apparatus having a mechanism adapted to move water along a path and a series of elutriation columns implemented along the path, each elutriation column having a vertical bore with water controlled to travel up the vertical bore at one velocity, and having also a capture element at the bottom of the bore, adding the particles from each section to the mechanism adapted to move the water along the path, and adding water to create a flow of water entraining the particles, and separating out particles of different density at each elutriation column of each elutriation apparatus in the plurality of elutriation apparatuses.

DETAILED DESCRIPTION OF THE INVENTION

Figure 1:
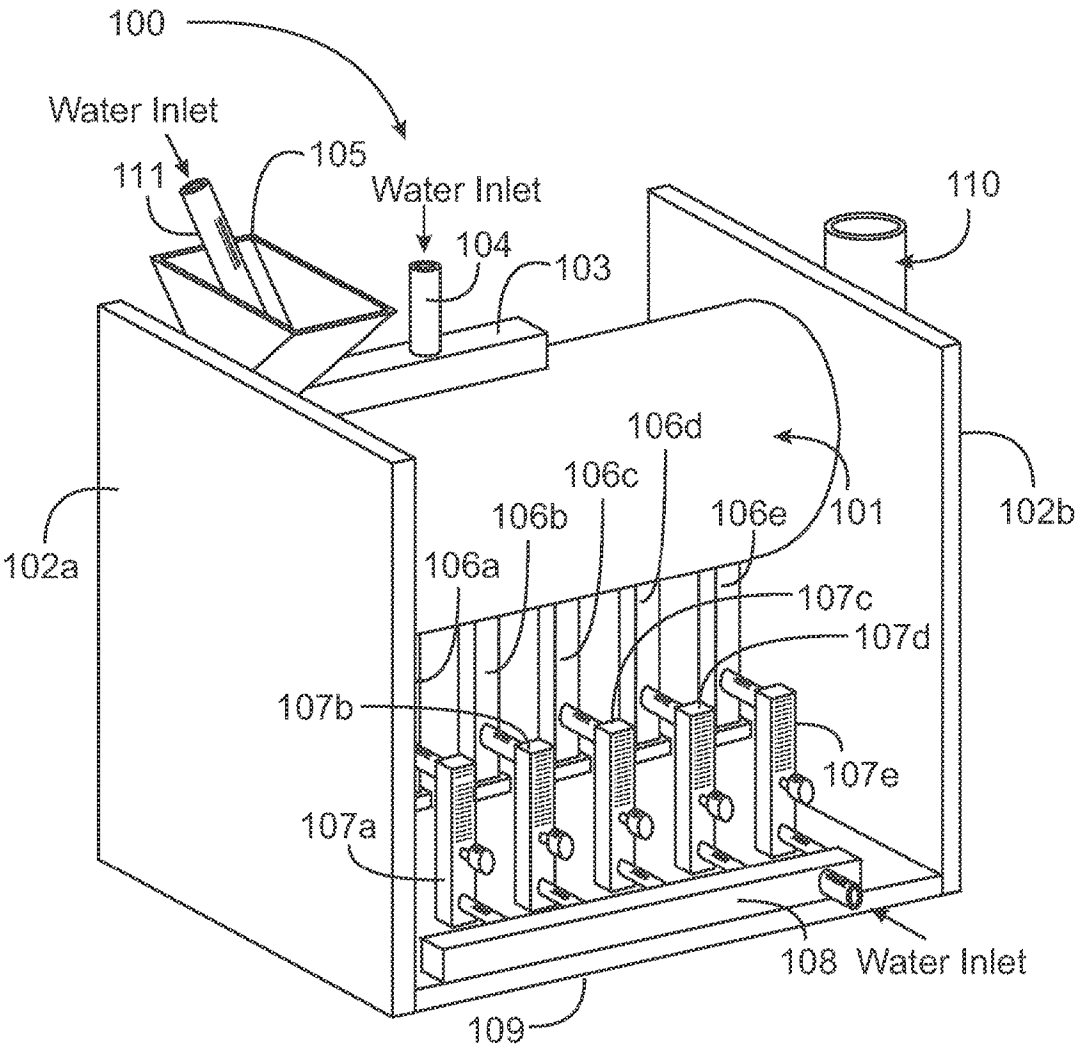
FIG. 1 is a perspective view of an assembled elutriation apparatus in an embodiment of the present invention.

FIG. 1 is a perspective view of an assembled elutriation apparatus 100 in one embodiment of the present invention. Elutriation apparatus 100 in this example has an outer cylindrical housing 101, and an inner cylindrical housing not seen in FIG. 1, concentric with outer housing 101. Internal characteristics of the apparatus within outer housing 101 is described in enabling detail below referring to additional figures.

In this example the concentric outer and inner housings are supported by end plates 102*a* and 102*b*. In some embodiments there may be a base plate 109 as well for additional stability. An important aspect of the invention is that a plurality of small vertical elutriation columns 106*a* through 106*e* in this example communicate with an annular horizontal region between the cylindrical housings. There are five distinct elutriation columns in this example, but there may be more or fewer in alternative embodiments of the invention.

Each vertical elutriation column has an internal bore that passes through outer cylindrical housing 101 into the region between the cylindrical housings. Each elutriation column has a lowermost removable cap in this example that enables access to remove material that has been separated by the specific elutriation column, and water is fed into a lower point of the elutriation column from a connected adjustable flow meter, one flow meter serving each one of the plurality of elutriation columns. Each flow meter is provided with a flow of water at a bottom point and feeds water to the connected elutriation column at an upper point, as shown. Each flow meter has a flow adjusting valve with a knob enabling flow adjustment. Water to the flow meters is fed from a manifold 108 that receives water at an inlet.

The elutriation columns 106*a* through 106*e* in this example each present a laminar upward flow of water in the elutriation column, such that entrained particles of solid material above a certain density will tend to settle in the column faster than the upward laminar flow of water and will collect at the removable cap at the bottom of the column. Entrained particles below that certain density cannot settle and will continue to be carried in the region between the concentric cylindrical housings to another of the elutriation columns. The density at which separation occurs is controlled by controlling the upward flow rate in each elutriation column, which may be adjusted by the connected flow meters to be different for each elutriation column in the series.

A mixture of material, including target material desired to be separated by elutriation in the apparatus and recovered is provided through a hopper 105 at one end, in this example the left end, which allows the material mix to enter though an opening in the outer cylindrical housing. Water is also added through a tube 111 within the hopper and creates a slurry of entrained particles in the water moving through the apparatus, which passes over each elutriation column, and eventually exits the apparatus at a drainpipe 110 in this example at the right end of the apparatus.

The mixture of materials introduced to hopper 105 cannot be a mixture of all sizes or granularities. In normal operations if 100 the mixture must only contain a small range of granularities. The raw process material must be sorted by granularity into ranges, and material in each range run separately, or in a different elutriation apparatus.

Water enters the apparatus at each one of the series of elutriation columns from the flow meters, through a manifold 103 that interfaces along a top edge of the outer cylindrical housing, and through the tube 111 at the hopper 105. Manifold 103 is fed by an inlet tube 104 and is connected internally to the annular space between the cylindrical housings at an angle, to move water along the region between the housings from left to right in this example. Internal details are described below with reference to additional illustrations.

Figure 2:
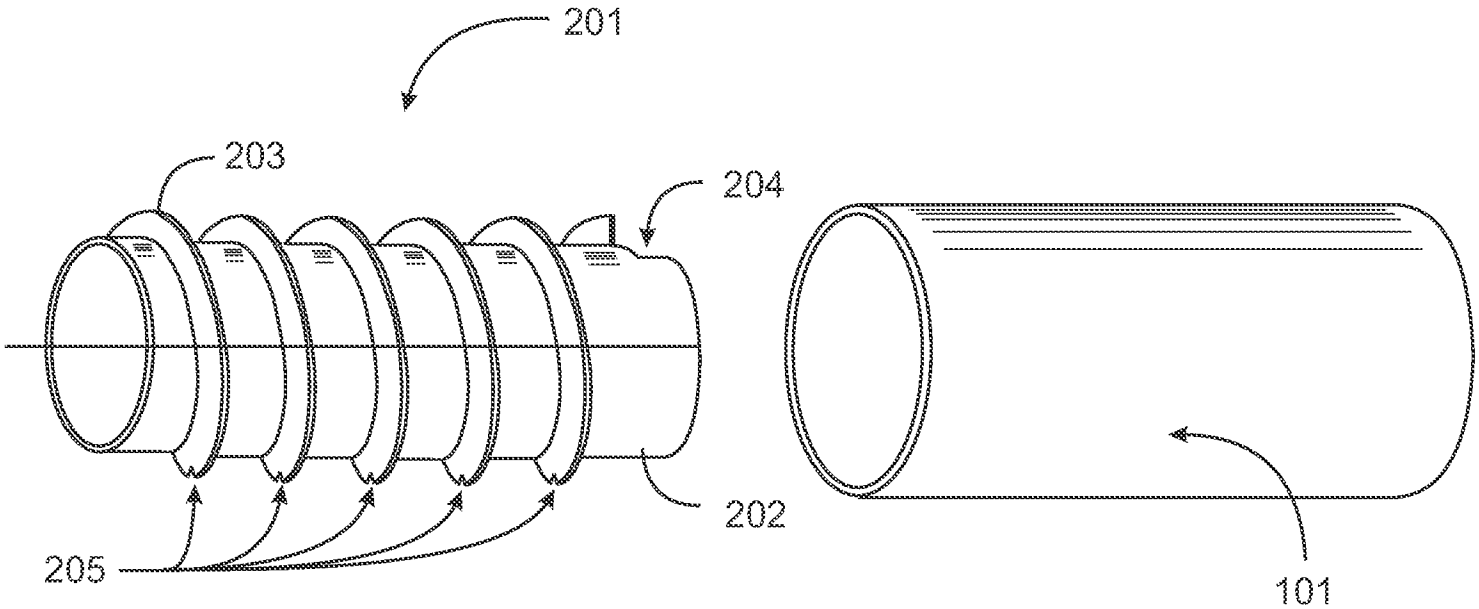
FIG. 2 is an exploded view of an outer and an inner cylindrical housing in an embodiment of the invention.

FIG. 2 is an exploded view of the inner and outer cylindrical housings with inner cylindrical housing 202 removed. FIG. 2 illustrates inner housing 202 with a spiral fin 203 joined to the outer diameter of cylindrical housing 202, forming a spiral guide assembly 201. The outer diameter of the spiral fin is just a bit smaller than the inside diameter of housing 101, so assembly 201 may fit comfortable into housing 101, forming a spiral path for water in the region between the housings. In one embodiment the outer edge of spiral fin 203 may have a flexible gasket. In this example the lengthwise spacing of the spiral fin is the same as the spacing of the entry points of the vertical elutriation columns into housing 101. In one embodiment the inside diameter of outer cylindrical housing 101 is 5.75 inches, and the outside diameter of inner cylindrical housing 202 is 4.50 inches, so the width of the annular space and the spiral fine is 0.625 inches. These dimensions may well be different in other embodiments of the invention. In FIG. 2 manifold 103 and the entrance of the elutriation chambers along the bottom of the outer cylindrical housing are not shown.

Figure 3:
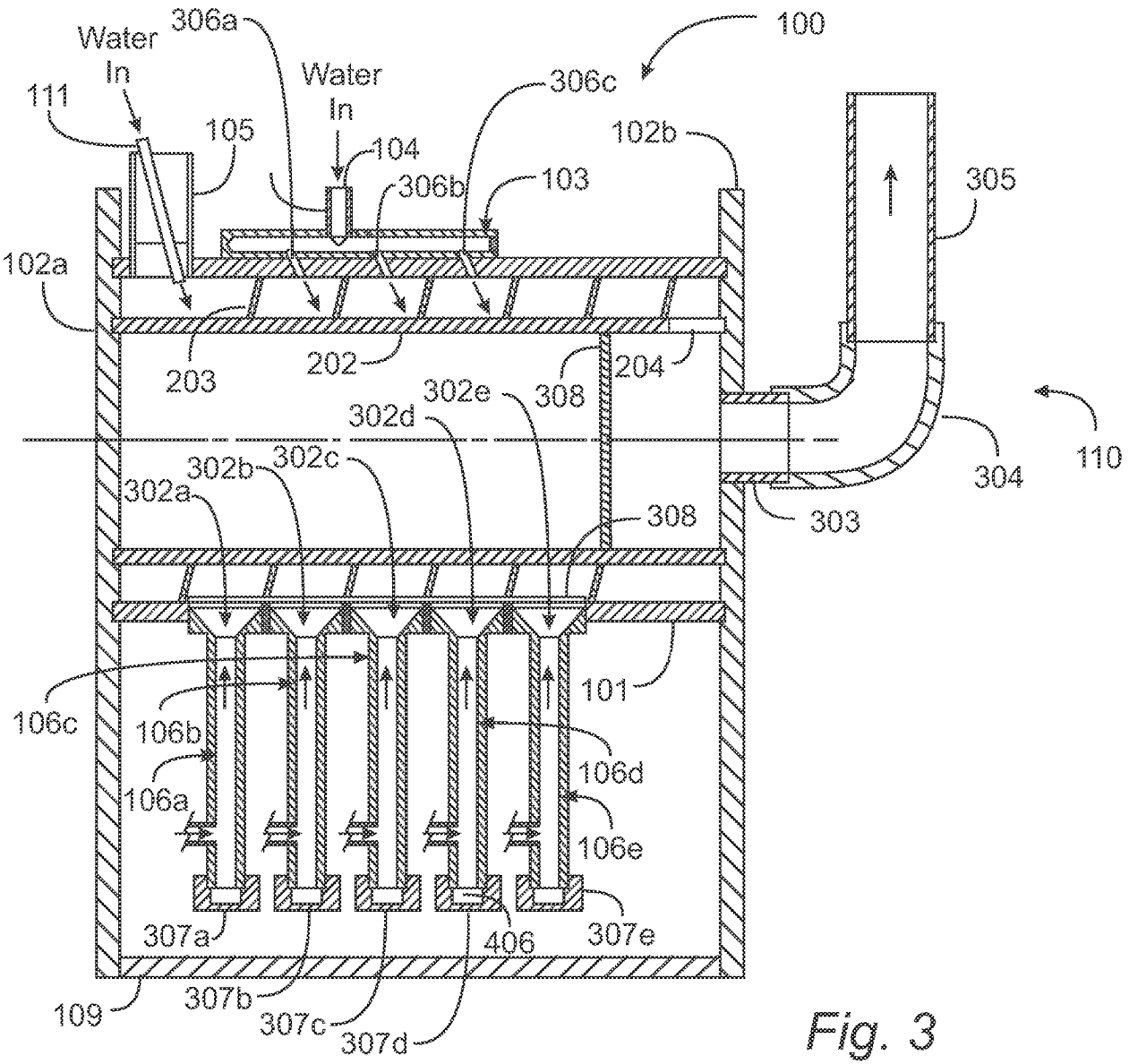
FIG. 3 is a lengthwise section view of the cylindrical housings and internal elements of the elutriation apparatus of FIG. 1.

FIG. 3 is a vertical cross section view of elutriation apparatus 100 (see FIG. 1) taken along the axis of concentric cylindrical housings 101 and 202. Spiral fin 203 is seen disposed between the inside diameter of housing 101 and the outside diameter of housing 202. The housings are stationary in the assembly, as is the fin, so this implementation provides a fixed spiral path in the annular space between the housings 15 such that water and material entering the apparatus follows this spiral path, from left to right in this example, to an exit.

Tubing assembly 110 comprises a short tube 303, an elbow 304, and a long tube 305. In one embodiment the short tube is joined to the end plate or to the elbow, or both, in a manner that the elbow may be rotated about the axis of the short tube. This arrangement enables a user to position tube 305 vertically, as shown in the figure, or to rotate the elbow so tube 305 is horizontal or may even point in a downward direction. With tube 305 vertical the annular space between housings 101 and 202, having the spiral path imposed by fin 203, will be full of water and entrained material, and excess water will spill over the top of tube 305. In some implementations tubing or hose connections may be made to drain the excess water through a drainage apparatus, not shown. By rotating tube 305 to be horizontal or to point downward the apparatus may be emptied, and with the tube horizontal or pointing down one may flush the apparatus.

Hopper 105, also shown in FIG. 1, provides an entry to the space between the assembled cylindrical housings on the top of the apparatus at the far left, in this example. This is the loading point for a user to introduce material to be separated. One example among many of material to be separated might be material panned from a streambed that is thought to contain gold dust. This is not a limitation in the invention, because material mixes of many and varied sorts may be processed by the serial elutriation apparatus according to embodiments of the present invention. I this example tube 111 passes into the apparatus through the hopper, and water provided by this tube creates the slurry and the initial impetus for water with entrained material to pass along the spiral annular path.

Manifold 103, also shown in FIG. 1, is implemented lengthwise along the top outside of cylindrical housing 101. Inlet 104 is an inlet for water to manifold 103, and passages 306*a*, 306*b* and 306*c* pass through the bottom of manifold 103 and through the top wall of housing 101 at an angle, as shown, that introduces water into the annular region between the housings, the inflow directed into the spiral passage at, in this example, three separate points. The arrangement of the spiral passage and the inlet passages from manifold 103 further promote the spiral water flow along the spiral passage from left to right, in this example, around the inner housing 202.

Five vertical elutriation columns 106*a* through 106*e*, also shown in FIG. 1, are illustrated in FIG. 3 as joined left to right along the direction of the axis of the housings and interfaced though the bottom wall of cylindrical housing 101. In one embodiment there may be more or fewer than five. Also in this example the five elutriation columns are implemented as an assembly that may be interfaced to outer cylindrical housing 101 through a single slot of a width equal to the width of a top of a single elutriation column.

The top of teach elutriation column is implemented as a cell designed to aid in the separation and capture of particles entrained in water passing around the spiral path between the housings. Each cell is, in this example, rectangular, in this example 1 inch wide and three inches long and has a tapered shape downward into a vertical bore of one-half inch diameter. The cell and column design in one embodiment is further described below with reference to additional figures. One slot, in this example, of one inch width and sixteen inches in length is made along the bottom of cylindrical housing 101 to accommodate assembly of the elutriation cells and columns. The sixteen-inch length takes into account four spacers of one-quarter inch each between cells to account for width of spiral fin 203.

Water is shown as entering each of the elutriation columns near the bottom of the column, which comes from five connected flow meters, as shown in FIG. 1. The flow meters are not illustrated in FIG. 3, and the entry is shown from the left just for convenience of description. As previously described, a laminar upward flow of water is induced in each elutriation column of one-half inch diameter in this example, by control of the connected flow meters, and the rate of flow may be different for each column.

With introduction of mixed particulate material at hopper 105, injection of water at tube 111 and at passages 306*a*, 306*b* and 306*c* along the top of housing 101 between walls of fin 203 forming the spiral passage, and water flowing into the apparatus upward in the five elutriation columns, water with particulate matter entrained passes over cell 302*a* of column 106*a* firstly, and particles dense enough to descend the column against the controlled upward flow of water will precipitate to the bottom of the column.

Each elutriation column comprises a bottom cap or door. In this example the bottom caps are 307*a* through 307*e*. Each cap has an internal space 406 as shown, where particulate material will settle. At certain intervals a user may remove the caps and collect the particulate material trapped in the caps. In the case of gold dust, this may be gold dust of different sizes and weight, determined by the different controlled upward flow of water in each elutriation column.

In some embodiments the bottom trap for collection may be a pivoted trap door that may be latched closed and unlatched to dump collected material into a collection container or strainer. In other embodiments a simple valve at the base of the cap may be opened to recover dense liquid target material.

After passing upper cell 302*a* of column 106*a* the water with entrained particles passes around the spiral path and passes over cell 302*b* of column 106*b*. Passage over cells 302*c*, 302*d* and 302*e* follows. Particles collected in each cap or door may be different in weight by control of the flow meters feeding the separate elutriation columns.

After passing cell 302*e* the water flows through an opening 204 implemented through outer cylindrical tube 101 into the inside of cylindrical tube 202 and out through tube 303 through end plate 102*b*, then upward in tube 305, and spills over the top of the tube, or is carried to a drain.

Figure 4A:
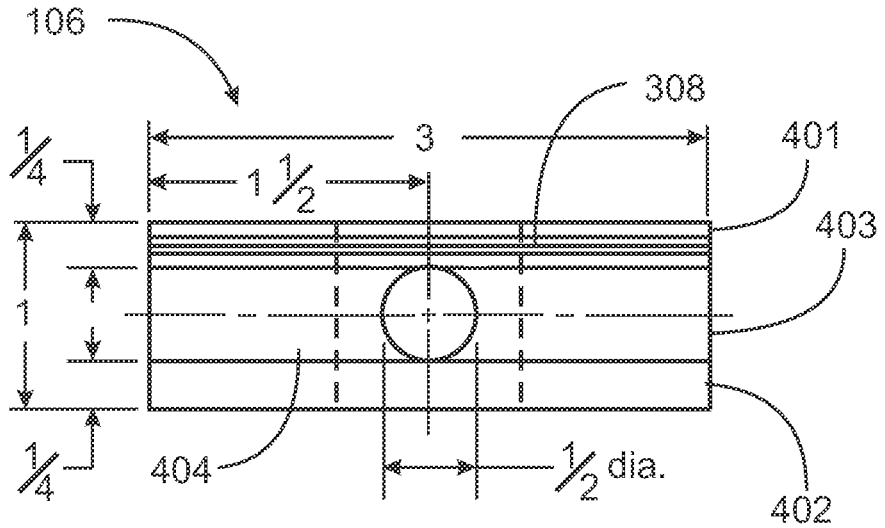
FIG. 4A is a top plan view of a cell at a top of an elutriation column in an embodiment of the invention.
Figure 4B:
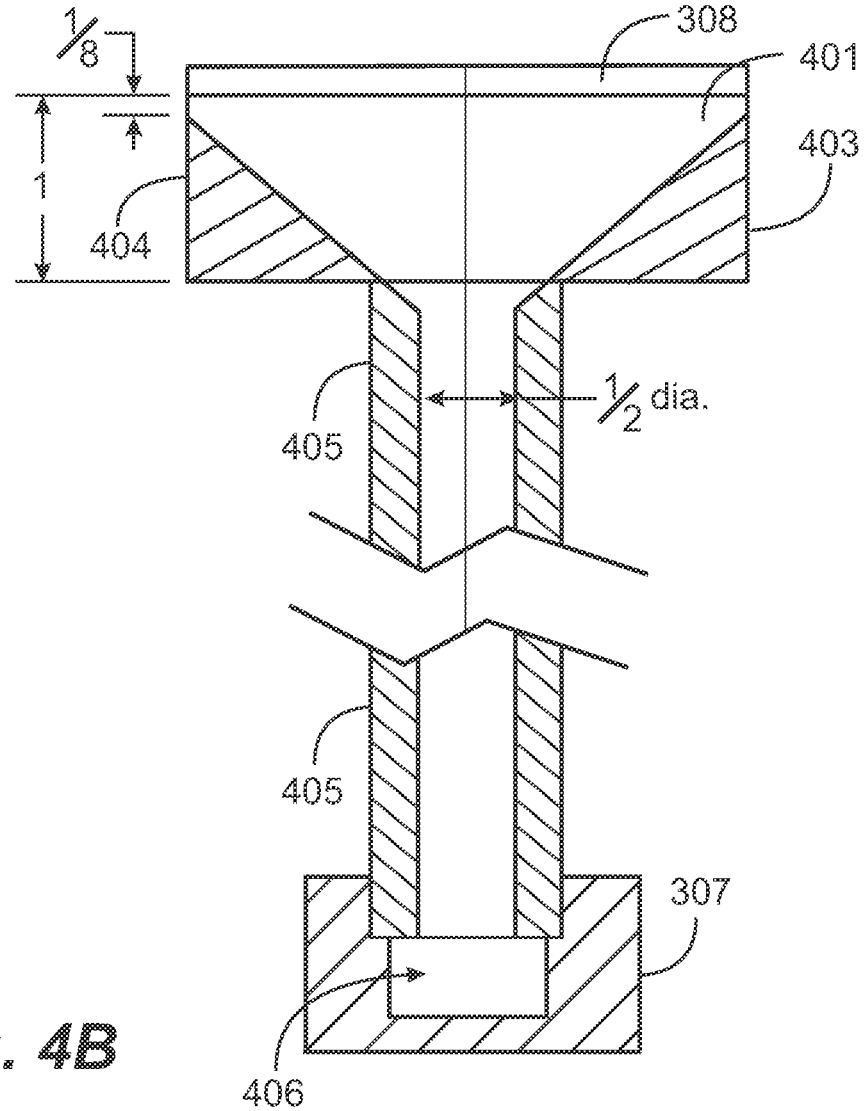
FIG. 4B is a section elevation view of the elutriation cell and column shown in top view in FIG. 4A.

FIG. 4A is a plan view of a top interface cell of an elutriation column 106 in an embodiment of the invention and is common to all five cells and columns. FIG. 4B is an elevation section view of the cell and elutriation column. The column is shown broken lengthwise in order that it may be illustrated large enough to show substantial detail.

FIG. 4A illustrates the top portion of the elutriation cell at the top of the column. The elutriation column and cell in this example comprises five separate parts 401, 402, 403, 404 and 405. Elements 401 and 402 are rectangular blocks in this example, one-quarter inch thick, three inches long and one inch in height. Elements 403 and 404 are triangular blocks of seven eighths inch high and one-half inch in thickness. Element 405 is the vertical column of the elutriation column, 1 inch square with a center ½ inch bore, in this example. It is emphasized that the dimensions given in this implementation are entirely exemplary, and that the dimensions may be quite different in alternative embodiments.

It is not a limitation of the invention that the elutriation column and the upper cell be made of five separate pieces as illustrated and described in this example. In some embodiments the entire unit may be molded from a polymer material or machined from a block of, for example, polycarbonate material, from another suitable plastic material. In some embodiments the unit may be metal or glass.

In this example a riffle element 308 is implemented along a top edge of element 401. The riffle element is a relatively thin rectangular piece of plastic three inches in length and in this example one-sixteenth in thickness. The riffle element is joined to the top edge of element 401 by a suitable adhesive or by engagement with a milled slot, or both. The riffle element in an operating apparatus protrudes into the flow stream that paces over the cell and interrupts the flow, causing turbulence that enhances capture of dense particles above the cell.

Cap 307, first shown in FIG. 3, is illustrated fitted to the lower end of the column, providing a volume 406 where settled particles may accumulate in operation. In this example the cap has a square opening sized such that the cap may be a firm slip fit over the square outside of column 405 and may be easily removed to access particles that may accumulate in volume 406. In alternative embodiments there may be an O-ring or other sealing mechanism to enhance the engagement. In another embodiment column 405 may be circular and the lower end may be threaded to engage a female thread in the cap. In yet another embodiment the lower end of the column may have a hinged door, latched or held closed by a spring.

Figure 5:
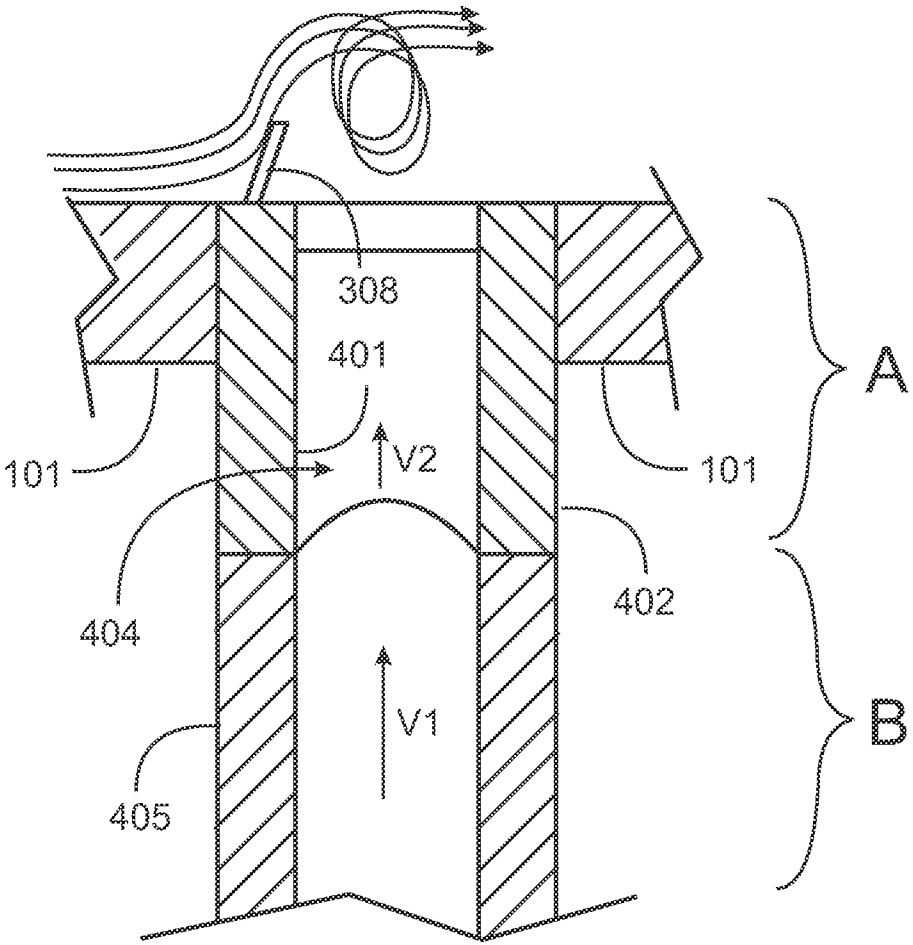
FIG. 5 is a section view of the elutriation cell and column of FIG. 4B rotated 90 degrees about a vertical axis.

FIG. 5 is an elevation section of the elutriation column of FIG. 4B, rotated 90 degrees to be seen from one end, shown inserted into a slot in the bottom of cylindrical housing 101 as seen in FIG. 3. An important result of the construction of the column and cell is that the velocity of water travelling up the column changes at the cell. In region B of the column the upward velocity of the water is V1 in the ½ inch bore of the column. In region A, because of the sloped sidewalls of elements 403 and 404 velocity V2 is much smaller than V1. Velocity V1 in any event is quite low to provide laminar flow, and to just allow particles of a threshold density to settle down the column against the flow of water. Riffle element 308 is shown protruding into the flow stream and producing turbulence.

Figure 6:
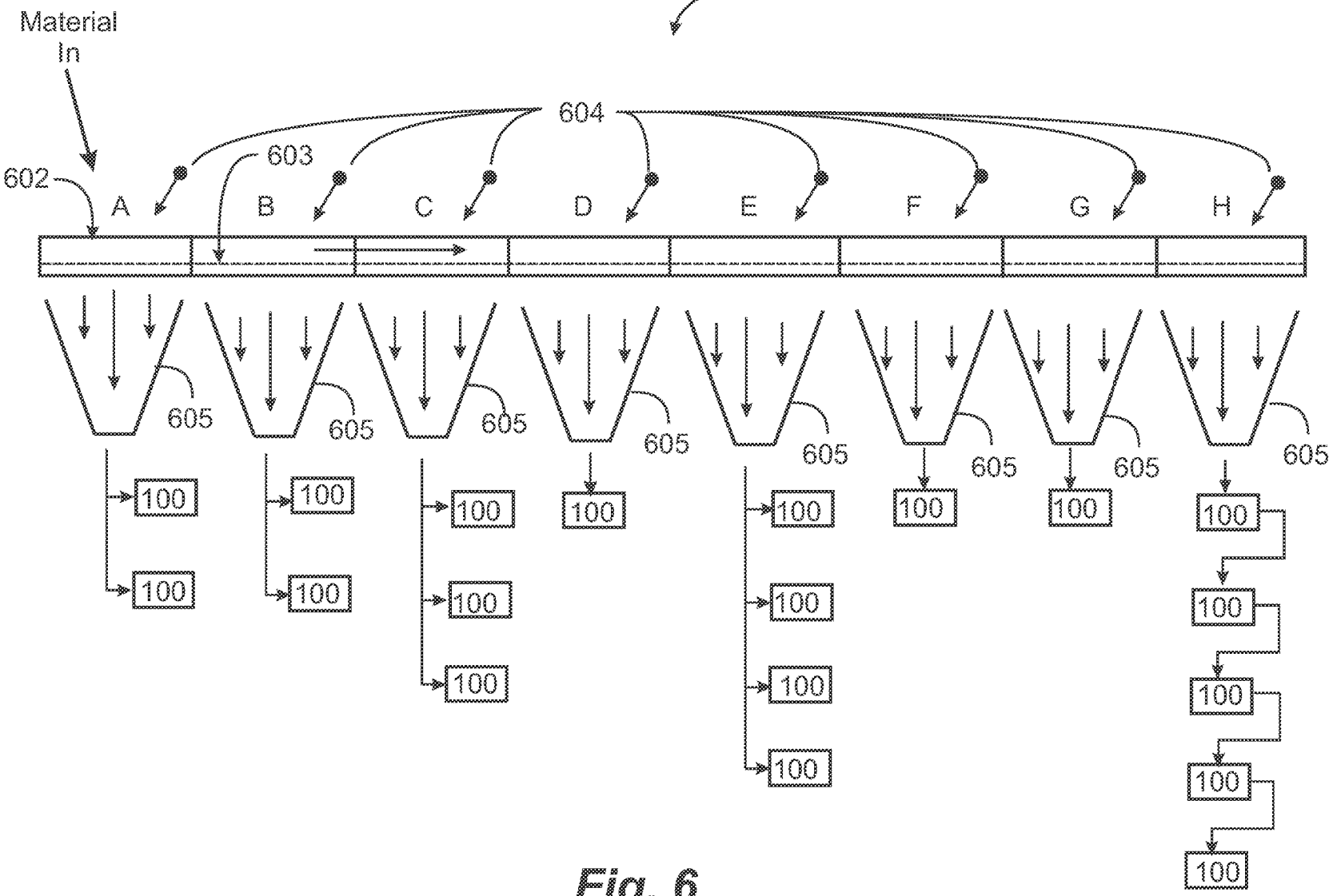
FIG. 6 is a diagram representing an apparatus with a screening machine feeding screened material to a plurality of elutriation apparatus.

FIG. 6 illustrates a scalable apparatus 601 termed a soil-washing apparatus in which a commercially available or proprietary screening machine may be incorporated to prescreen material that may comprise particles of a broad range of density that may be sorted and recovered by a battery of elutriation apparatus of the sort described above with reference to FIGS. 1 through 5.

FIG. 6 is diagrammatical. In FIG. 6 a screening machine 602 comprises a plurality of sections A through H along which material may be conducted. Each section A through H has a screen 603 that may be of a specific granularity to separate particles from the aggregate. Each section may have a high-pressure spray wash 604 that may be controlled as to volume and intensity, and each screen may be vibrated differently. The different granularity, power wash and vibration is set to separate material of a certain range of sizes from the aggregate.

Material separated out at each section of the screening machine is gathered through an apparatus 605 and fed to one or more elutriation apparatus 100 that are assembled and operated according to an embodiment of the present invention as described in enabling detail above.

Material from a section of machine 602 may be processed by just one elutriation apparatus 100, as seen, for example, for sections D, F and G. For other sections material may be fed to more than one elutriation apparatus. Sections A and B each have two elutriation apparatuses, section C, has three, section E four, and section H five. The number of following apparatuses from each section of the screening machine 602 may be determined by the volume of material separated out at each section of the screening machine. The person of ordinary skill will understand that scalability is quite broad. In this example the material separated out by last section H of the screening machine may comprise particles of different densities and may be passed through a series of elutriation apparatuses as shown.

A person with ordinary skill in the art will understand that the details of construction and all the embodiments illustrated and described herein are entirely exemplary, and not limiting to the scope of the invention. A unique innovation in this invention is that water with particles of material entrained may be guided over a plurality of elutriation columns, each of which may have characteristics, including flow characteristics, that a different threshold for mass to separate may be established at each column, so material of different mass characteristics may be separated out of the water flow and collected at different points in the apparatus. In a broad sense there may be just two (or more) columns and the mechanism of adding material to water and causing the water to flow over the columns may vary in many ways. In one implementation, for example, there may be an open trough conducting water with entrained particles, and columns may be interfaced to different positions in the bottom of the trough. It is not necessary that the trough be straight, as it may be curved or have intersections that act to stir the water with entrained particles.

The invention is limited only by the claims.

I claim:

1. An elutriation apparatus, comprising:

a mechanism adapted to move water along a spiral path, the water entraining material particles of different density, the mechanism comprising a stationary outer cylindrical housing having a horizontal central axis and a length from a first end to a second end assembled concentrically with a stationary inner cylindrical housing of the same length having the same central axis, creating an annular space between the housings, with a spiral fin implemented in the annular space between the cylindrical housings, providing a spiral path from the first end to the second end;

an input port into the spiral path through the outer cylindrical housing at a first end;

a first exit port from the spiral path through the inner cylindrical housing to a volume within the inner cylindrical housing; and a plurality of vertically oriented elutriation columns interfaced through the stationary outer cylindrical housing, along a line at a lowermost point of the outer cylindrical housing parallel with the central axis, each elutriation column having a vertical bore with water controlled to travel up the vertical bore at one velocity, and having also a capture element at the bottom of the bore;

characterized in that water and particles are input at the input port causing a flow of water with entrained particles along the spiral path, and as the water with entrained particles passes over each interface to an elutriation column along the path, particles of a density sufficient for the particles to settle in the elutriation column at a velocity greater than the upward velocity of water in the bore of the elutriation column, settle to the bottom of the column, and particles of lesser density pass on to a next elutriation column interfaced along the path.

2. The elutriation apparatus of claim 1 wherein each elutriation column in the plurality of elutriation columns is fed water by an adjustable flow meter, such that the upward velocity of flow in each elutriation column is different, and particles of a different density are collected in each of the elutriation columns.

3. The elutriation apparatus of claim 1 wherein the capture element is a removable cap, such that the cap may be removed to remove particles captured in the cap.

4. The elutriation apparatus of claim 1 further comprising a hopper engaged to the input port adapted to receive a mixture of particulate material, a water injection tube passing into the spiral path through the hopper, and a second opening through a top region of the inner cylindrical housing proximate the second end, such that water injected via the injection tube urges the water with entrained particles along the spiral path, and the water flows at the second end downward through the first exit port into a volume constrained by the inner cylindrical housing.

5. The elutriation apparatus of claim 4 further comprising a drainpipe coupled into the inner volume of the inner cylindrical housing, the drainpipe extending in the direction of the axis out of the inner volume and then upward to a level above an uppermost edge of the outer cylindrical housing, such that water fills the spiral path, flows out and up in the drainpipe, and exits at the top of the drainpipe.

6. The elutriation apparatus of claim 5 wherein the drainpipe is adapted to rotate about the axis of the cylindrical housings, such that the apparatus may be drained by rotating the drainpipe, so the exit of the drainpipe is below a lowermost edge of the outer cylindrical housing.

7. A method for separating particles of different density from a mixture of material having particles of different density, comprising:

placing a portion of the mixture of material having particles of different density into a hopper of an elutriation apparatus having a mechanism adapted to move water along a path, the mechanism comprising a stationary outer cylindrical housing having a horizontal central axis and a length from a first end to a second end assembled concentrically with a stationary inner cylindrical housing of the same length having the same central axis, creating an annular space between the housings, with a spiral fin implemented in the annular space between the cylindrical housings, providing a spiral path from the first end to the second end, the hopper interfaced to an entry port through the outer cylindrical housing at a first end of the mechanism into the spiral path;

adding water through an inlet through the hopper, creating a flow of water entraining particles of different density along the spiral path;

interfacing a plurality of elutriation columns through the stationary outer cylindrical housing, along a line at a lowermost point of the outer cylindrical housing parallel with the central axis, each elutriation column having a vertical bore with water controlled to travel up the vertical bore at one velocity, and having also a capture element at the bottom of the bore;

separating from the water entraining particles of different density, at each elutriation column, particles of a density sufficient for the particles to settle in the elutriation column at a velocity greater than the upward velocity of water in the bore of the elutriation column; and collecting the separated particles from the capture element at the bottom of each elutriation column.

8. The elutriation apparatus of claim 1 wherein the plurality of elutriation columns are implemented in a row, side, by side, with a spacing the same as the spacing of one complete turn of the spiral path, such that the interface of each elutriation column enters the spiral path centrally between turns of the spiral fin, so that the water with entrained particles passes over each interface in turn as the water follows the spiral path.

9. The elutriation apparatus of claim 8 wherein the interface of each elutriation column has a rectangular horizontal cross section with a length and a width, the length of the interface aligned in the axis direction of the housings, and a rectangular upper opening tapers to a round bore of the elutriation column.

10. The elutriation apparatus of claim 9 wherein the bore is one-half inch in diameter, the length of the rectangular upper opening is three inches and the width of the rectangular upper opening is one-half inch.

11. The elutriation apparatus of claim 9 wherein the rectangular upper opening is even with the inside diameter of the outer cylindrical housing, and the interface further comprises a riffle panel extending upward along the length of one side of the interface such that the water with entrained particles passes over the riffle panel before passing over the rectangular upper opening, and the riffle panel creates turbulence in the water over the rectangular upper opening.

* * * * *